US010487843B2

(12) United States Patent
Drozdenko et al.

(10) Patent No.: US 10,487,843 B2
(45) Date of Patent: Nov. 26, 2019

(54) FAN BLADES AND MANUFACTURE METHODS

(71) Applicant: United Technologies Corporation, Hartford, CT (US)

(72) Inventors: Lee M. Drozdenko, Bristol, CT (US); James O. Hansen, Glastonbury, CT (US); Maria C. Kirejczyk, Middletown, CT (US); Scot A. Webb, Gales Ferry, CT (US); Jesse C. Meyer, Colchester, CT (US); Brandon A. Gates, DeWitt, MI (US); Richard B. Bergethon, Holt, MI (US); Michael A. Morden, Holt, MI (US)

(73) Assignee: United Technologies Corporation, Farmington, CT (US)

( * ) Notice: Subject to any disclaimer, the term of this patent is extended or adjusted under 35 U.S.C. 154(b) by 716 days.

(21) Appl. No.: 14/917,485

(22) PCT Filed: Aug. 4, 2014

(86) PCT No.: PCT/US2014/049576
§ 371 (c)(1),
(2) Date: Mar. 8, 2016

(87) PCT Pub. No.: WO2015/069335
PCT Pub. Date: May 14, 2015

(65) Prior Publication Data

US 2016/0215784 A1 Jul. 28, 2016

Related U.S. Application Data

(60) Provisional application No. 61/875,622, filed on Sep. 9, 2013.

(51) Int. Cl.
*F04D 29/02* (2006.01)
*F01D 5/28* (2006.01)
(Continued)

(52) U.S. Cl.
CPC ..... *F04D 29/023* (2013.01); *F01D 5/288* (2013.01); *F04D 29/325* (2013.01);
(Continued)

(58) Field of Classification Search
CPC ..... F04D 29/02; F04D 29/023; F04D 29/64; F04D 29/644; F04D 29/38; F04D 29/388;
(Continued)

(56) References Cited

U.S. PATENT DOCUMENTS 3,628,890 A * 12/1971 Sayre ..... F01D 5/282 416/220 R
3,762,835 A * 10/1973 Carlson ..... B29C 70/04 416/224
(Continued)

FOREIGN PATENT DOCUMENTS

EP 2241432 A2 10/2010
EP 2348192 A2 7/2011
(Continued)

OTHER PUBLICATIONS

Data Sheet—Product Information, received Jul. 9, 2013 from http://bgf.com/FabricSearch/DataSheet.asp?FabricID=244&MeasurementFormat=English, BGE Industries, Inc., Greensboro, North Carolina.

(Continued)

*Primary Examiner* — Carlos A Rivera
*Assistant Examiner* — Wayne A Lambert
(74) *Attorney, Agent, or Firm* — Bachman & LaPointe, P.C.

(57) ABSTRACT

An airfoil member (100) comprising has a substrate (120) along at least a portion of an airfoil (102) of the airfoil member. A sheath (122) has a channel (144) receiving a portion (160) of the substrate. A scrim (200) is between the substrate and the sheath. A spacer (220) is between the
(Continued)

sheath and the substrate and has a plurality of spaced-apart portions (232, 234) with gaps between the spaced-apart portions.

19 Claims, 6 Drawing Sheets

(51) Int. Cl.
*F04D 29/32* (2006.01)
*F04D 29/38* (2006.01)
*F04D 29/64* (2006.01)

(52) U.S. Cl.
CPC ..... *F04D 29/388* (2013.01); *F04D 29/644* (2013.01); *F05D 2300/173* (2013.01); *F05D 2300/174* (2013.01); *F05D 2300/6033* (2013.01)

(58) Field of Classification Search
CPC ..... F04D 29/324; F04D 29/325; F01D 5/28; F01D 5/282; F01D 5/288; F01D 5/14; F01D 5/147; F05D 2300/6033; F05D 2300/173; F05D 2300/174; F05D 2300/614; F05D 2300/433; F05D 2220/36; F05D 2240/303; F05D 2260/95
See application file for complete search history.

(56) References Cited

U.S. PATENT DOCUMENTS 3,892,612 A * 7/1975 Carlson ..... F01D 5/282 156/150
4,006,999 A * 2/1977 Brantley ..... F01D 5/282 416/224
4,856,162 A * 8/1989 Graff ..... B23K 20/02 29/889.6
5,174,024 A 12/1992 Sterrett
5,279,892 A * 1/1994 Baldwin ..... B29C 70/08 442/206
5,375,978 A * 12/1994 Evans ..... B64C 11/26 416/224
5,486,096 A * 1/1996 Hertel ..... B64C 27/46 156/313
5,725,354 A * 3/1998 Wadia ..... F01D 5/147 416/224
5,881,972 A * 3/1999 Smith ..... B64C 11/205 244/121
5,887,332 A * 3/1999 Champenois ..... B29C 37/0082 264/258
6,280,550 B1 * 8/2001 Steibel ..... B32B 18/00 156/182
7,182,581 B2 * 2/2007 Bostanjoglo ..... C23C 28/3215 416/229 A
7,510,778 B2 * 3/2009 Bernard ..... B23P 15/04 416/224
7,736,130 B2 * 6/2010 Schilling ..... B64C 11/205 416/224
8,105,042 B2 * 1/2012 Parkin ..... B29C 65/5057 416/223 R
2003/0071019 A1 * 4/2003 Cline ..... C23F 1/26 216/109
2007/0092379 A1 * 4/2007 Coupe ..... B29B 11/16 416/241 R
2007/0190352 A1 * 8/2007 Bayer ..... C23C 8/02 428/627
2008/0075601 A1 * 3/2008 Giusti ..... F01D 5/147 416/229 A
2008/0185454 A1 * 8/2008 Vontell ..... F01D 9/041 237/28
2008/0258009 A1 * 10/2008 Alvarez ..... B64C 3/24 244/133
2009/0142193 A1 6/2009 Bech
2010/0008788 A1 * 1/2010 Barbee ..... F01D 5/288 416/224
2010/0254821 A1 10/2010 Parkin et al.
2011/0033308 A1 2/2011 Huth et al.
2011/0038732 A1 * 2/2011 Huth ..... B29C 70/24 416/229 A
2011/0049297 A1 3/2011 Jevons et al.
2011/0182740 A1 * 7/2011 Klinetob ..... F01D 5/147 416/224
2011/0194941 A1 * 8/2011 Parkin ..... B29C 70/48 416/224
2011/0211967 A1 9/2011 Deal et al.
2011/0229334 A1 9/2011 Alexander
2011/0286854 A1 * 11/2011 Watson ..... F01D 5/288 416/241 R
2012/0134839 A1 5/2012 Parkin et al.
2012/0156049 A1 6/2012 Hong
2012/0263596 A1 * 10/2012 Evans ..... F01D 5/28 416/193 A
2012/0301292 A1 * 11/2012 Deal ..... F01D 5/147 415/220
2013/0004323 A1 1/2013 Hansen et al.
2013/0089428 A1 4/2013 Hottier et al.
2013/0156588 A1 6/2013 Murdock et al.
2013/0177440 A1 * 7/2013 Zhang ..... C04B 41/52 416/241 R
2013/0185938 A1 * 7/2013 Dambrine ..... B21D 53/78 29/889.71
2013/0186507 A1 * 7/2013 Godon ..... B64C 11/26 139/425 R
2013/0219717 A1 * 8/2013 Dambrine ..... B21D 53/78 29/889.7
2013/0220537 A1 * 8/2013 Parkin ..... F04D 29/324 156/285
2013/0220542 A1 * 8/2013 Parkin ..... F04D 29/324 156/331.7
2013/0312261 A1 * 11/2013 Godon ..... B21D 53/78 29/889.71
2013/0333214 A1 * 12/2013 Godon ..... B21D 22/022 29/889.7
2013/0333215 A1 * 12/2013 Godon ..... B23K 20/021 29/889.71
2014/0030105 A1 * 1/2014 Fameau ..... F01D 5/147 416/229 A
2014/0119936 A1 * 5/2014 Dahl ..... B29C 70/547 416/230
2014/0193271 A1 * 7/2014 Dudon ..... B23P 15/04 416/241 R

FOREIGN PATENT DOCUMENTS

EP 2362067 A2 8/2011
EP 2540978 A2 1/2013

OTHER PUBLICATIONS

Advanced Composites, High Performance Fabrics for Structural Integrity, Dec. 2008, BGF Industries, Inc., Greensboro, North Carolina.
3M Scotch-Weld Structural Adhesive Film AF 3109-2, May 2002, 3M, St. Paul, Minnesota.
Customer Acceptance Standard: Fiberglass B/C Sewing Thread, Jun. 14, 2004, AGY Holding Corp., Aiken, South Carolina.
Customer Acceptance Standard: Fiberglass Continuous Filament Yarn for the Weaving Industry, Jul. 8, 2013, AGY Holding Corp., Aiken, South Carolina.
Hysol EA 9689 Epoxy Film Adhesive, May 14, 2007, Henkel Corporation, Bay Point, California.
International Search Report for PCT/US2014/049576, dated May 27, 2015.
International Search Report for PCT/US2014/049586, dated Nov. 24, 2014.

(56) References Cited

OTHER PUBLICATIONS

European Search Report for EP Patent Application No. 14860986.0, dated Oct. 18, 2016.

* cited by examiner

FAN BLADES AND MANUFACTURE METHODS

CROSS REFERENCE TO RELATED APPLICATION

Benefit is claimed of U.S. Patent Application Ser. No. 61/875,622, filed Sep. 9, 2013, and entitled "Fan Blades and Manufacture Methods", the disclosure of which is incorporated by reference herein in its entirety as if set forth at length.

BACKGROUND

The disclosure relates to turbine engine. More particularly, the disclosure relates to bonding galvanically dissimilar sheaths and substrates.

In a number of situations in gas turbine engine cold section components such as blades and vanes, a protective sheath is used to protect a substrate or main body of the component. Such sheaths may offer protection from foreign object damage or wear to leading edge and/or trailing edge portions of airfoils. In such situations, the sheath forms a limited portion of the airfoil contour with the main body providing the rest.

In some examples, the sheath may be of a more expensive material than the main body (e.g., a titanium alloy sheath on an aluminum alloy body where the aluminum alloy is used for cost reasons). In others, the sheath may be of a less expensive material (e.g., when the body is of a very light material with little impact resistance (e.g., a carbon fiber composite)).

US patent application publications 20110211967 and 20120301292 disclose a sheath bonded to blade substrate using a scrim and epoxy. The scrim and epoxy may galvanically isolate the sheath from the substrate to prevent corrosion.

SUMMARY

One aspect of the disclosure involves an airfoil member comprising a substrate along at least a portion of an airfoil of the blade. A sheath has a channel receiving a portion of the substrate. A scrim is between the substrate and the sheath. A spacer is between the sheath and the substrate and has a plurality of spaced-apart portions with gaps between the spaced-apart portions.

A further embodiment may additionally and/or alternatively include the airfoil member being a blade.

A further embodiment may additionally and/or alternatively include the spacer being between the scrim and the substrate.

A further embodiment may additionally and/or alternatively include: the substrate being a first metallic material; and the sheath being a second metallic material different from the first metallic material.

A further embodiment may additionally and/or alternatively include: the first metallic material being an aluminum alloy; and the second metallic material being a titanium alloy.

A further embodiment may additionally and/or alternatively include the scrim comprising glass fiber mesh.

A further embodiment may additionally and/or alternatively include the scrim has only a single mesh layer.

A further embodiment may additionally and/or alternatively include the spacer comprising a fibrous sheet.

A further embodiment may additionally and/or alternatively include the spacer comprising glass fiber.

A further embodiment may additionally and/or alternatively include the glass fiber being formed as a woven sheet.

A further embodiment may additionally and/or alternatively include the spacer comprising: a spine having a first edge and a second edge; a plurality of first arms extending from the first edge; and a plurality of second arms extending from the second edge.

A further embodiment may additionally and/or alternatively include: the spine being between a base of the channel and an edge of the received portion of the substrate; the first arms extending downstream from the spine along a pressure side of the received portion; and the second arms extending downstream from the spine along a suction side of the received portion.

A further embodiment may additionally and/or alternatively include the spacer having a characteristic thickness of 0.15 mm to 0.40 mm; and the scrim having a characteristic thickness of 0.05 mm to 0.15 mm.

A further embodiment may additionally and/or alternatively include the airfoil member being a fan blade.

A further embodiment may additionally and/or alternatively include the sheath forming a leading edge of the airfoil.

A further embodiment may additionally and/or alternatively include a method for manufacturing the blade. The method comprises: applying the spacer to the substrate; applying the scrim to the spacer and substrate; and applying the sheath to the scrim.

A further embodiment may additionally and/or alternatively include the spacer being applied as a prepreg.

A further embodiment may additionally and/or alternatively include the prepreg. being an epoxy prepreg.

A further embodiment may additionally and/or alternatively include the applying of the sheath leaving end portions of the spaced-apart portions protruding along the substrate.

A further embodiment may additionally and/or alternatively include cutting off the end portions.

A further embodiment may additionally and/or alternatively include applying an adhesive to secure the scrim to the substrate and applying an adhesive to secure the sheath to the scrim.

A further embodiment may additionally and/or alternatively include a turbine engine comprising the airfoil member as a fan blade.

A further embodiment may additionally and/or alternatively include the sheath forming a leading edge of the airfoil.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
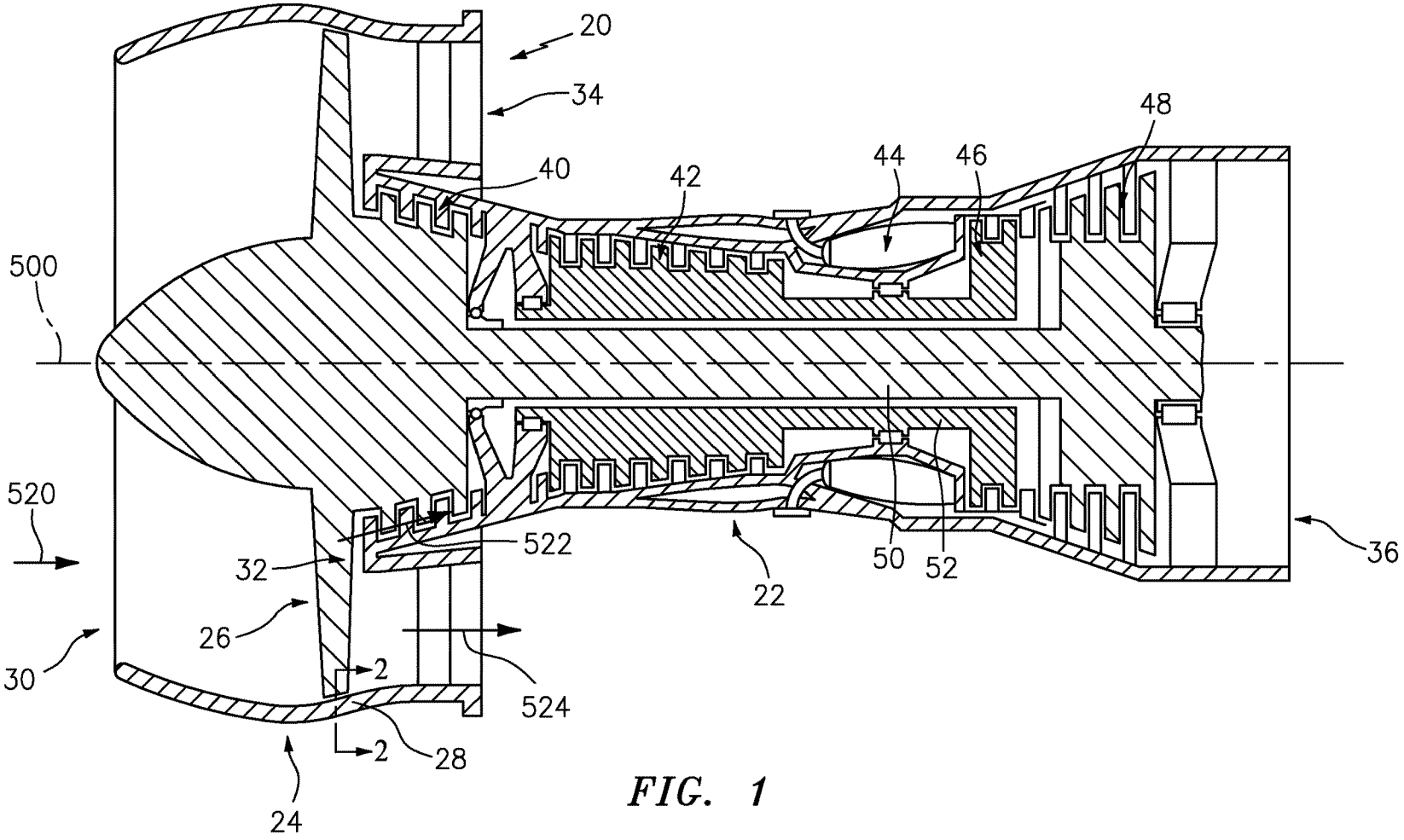
FIG. 1 is a partially schematic half-sectional view of a turbofan engine.

FIG. 1 shows a gas turbine engine 20 having an engine case 22 surrounding a centerline or central longitudinal axis 500. An exemplary gas turbine engine is a turbofan engine having a fan section 24 including a fan 26 within a fan case 28. The exemplary engine includes an inlet 30 at an upstream end of the fan case receiving an inlet flow along an inlet flowpath 520. The fan 26 has one or more stages 32 of fan blades. Downstream of the fan blades, the flowpath 520 splits into an inboard portion 522 being a core flowpath and passing through a core of the engine and an outboard portion 524 being a bypass flowpath exiting an outlet 34 of the fan case.

The core flowpath 522 proceeds downstream to an engine outlet 36 through one or more compressor sections, a combustor, and one or more turbine sections. The exemplary engine has two axial compressor sections and two axial turbine sections, although other configurations are equally applicable. From upstream to downstream there is a low pressure compressor section (LPC) 40, a high pressure compressor section (HPC) 42, a combustor section 44, a high pressure turbine section (HPT) 46, and a low pressure turbine section (LPT) 48. Each of the LPC, HPC, HPT, and LPT comprises one or more stages of blades which may be interspersed with one or more stages of stator vanes.

In the exemplary engine, the blade stages of the LPC and LPT are part of a low pressure spool mounted for rotation about the axis 500. The exemplary low pressure spool includes a shaft (low pressure shaft) 50 which couples the blade stages of the LPT to those of the LPC and allows the LPT to drive rotation of the LPC. In the exemplary engine, the shaft 50 also drives the fan. In the exemplary implementation, the fan is driven via a transmission (not shown, e.g., a fan gear drive system such as an epicyclic transmission) to allow the fan to rotate at a lower speed than the low pressure shaft.

The exemplary engine further includes a high pressure shaft 52 mounted for rotation about the axis 500 and coupling the blade stages of the HPT to those of the HPC to allow the HPT to drive rotation of the HPC. In the combustor 44, fuel is introduced to compressed air from the HPC and combusted to produce a high pressure gas which, in turn, is expanded in the turbine sections to extract energy and drive rotation of the respective turbine sections and their associated compressor sections (to provide the compressed air to the combustor) and fan.

Figure 2:
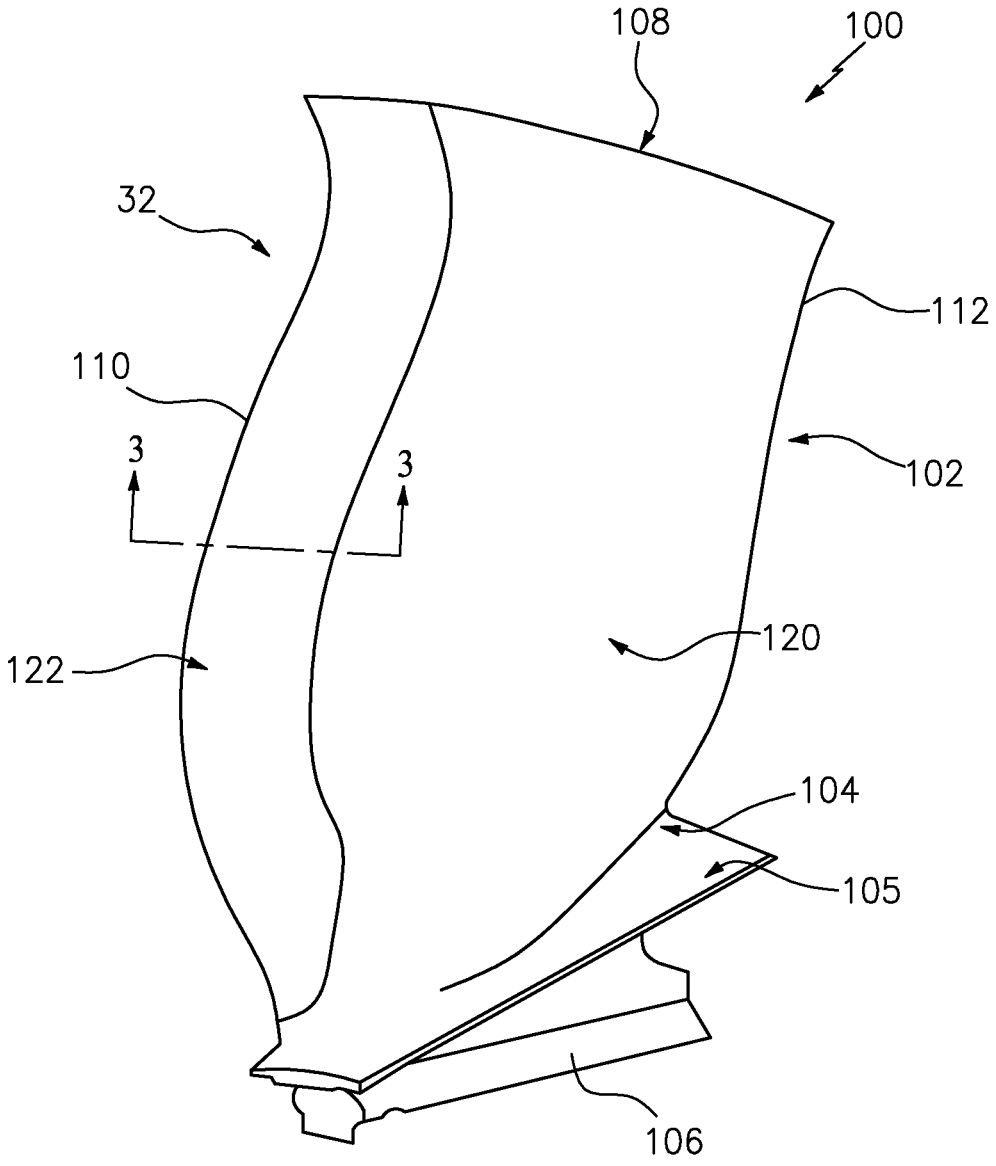
FIG. 2 is a view of a fan blade of the engine of FIG. 1.

FIG. 2 shows a fan blade 100. The blade has an airfoil 102 extending spanwise outward from an inboard end 104 at a platform 105 or an attachment root 106 to a tip 108 (e.g., an unshrouded or "free" tip). The airfoil has a leading edge 110, trailing edge 112, pressure side 114 (FIG. 3) and suction side 116.

In the exemplary blade, a metallic member forms a main body 120 of the airfoil and overall blade to which a leading edge sheath 122 is secured. Exemplary main bodies 120 are aluminum-based and exemplary leading edge sheathes are titanium-based. Such materials are disclosed in US patent application publications 20110211967 and 20120301292. Alternative main body materials include carbon fiber composites. However, other configurations of blades and other articles are possible. Other airfoil articles include other cold section components of the engine including fan inlet guide vanes, fan exit guide vanes, compressor blades, and compressor vanes or other cold section vanes or struts.

Figure 3:
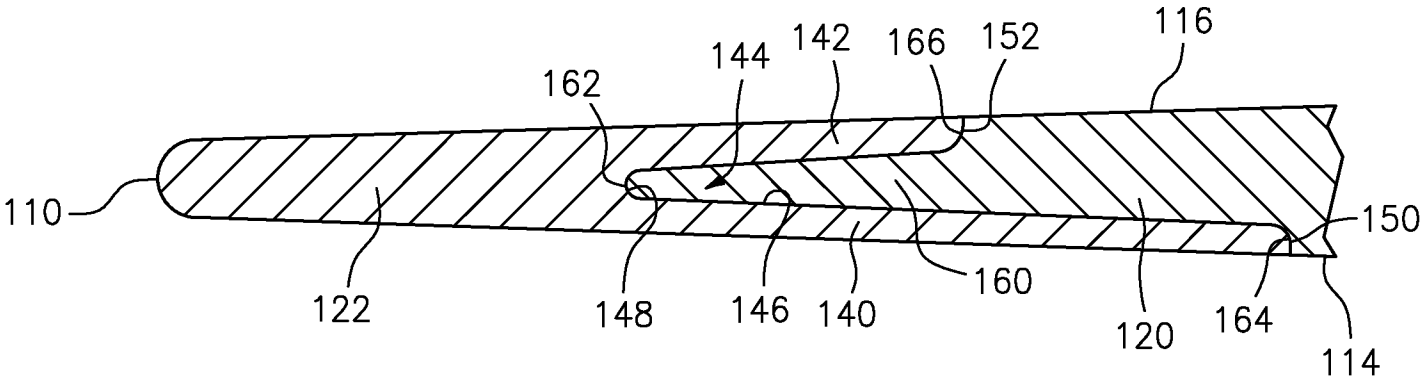
FIG. 3 is a partial sectional view of the blade of FIG. 2, taken along line 3-3.

FIG. 3 is a sectional view of a leading portion of the airfoil of the blade of FIG. 2. The sheath 122 is formed as a channel structure having portions 140 and 142 respectively along the pressure side and suction side. The portions 140 and 142 are on opposite sides of a channel 144 formed by an inner surface 146 of the sheath and extending downstream from a base 148. The portions 140 and 142 respectively extend downstream to downstream edges 150 and 152.

The sheath 122, in its channel 144, receives a leading portion 160 of the main body 120. The exemplary leading portion 160 extends downstream from a leading edge 162 to respective pressure side and suction side shoulders 164 and 166. The shoulders separate the leading portion from respective portions of the airfoil pressure and suction side surfaces along the main body 120.

To galvanically isolate the sheath 122 from the main body 120, a scrim 200 (FIGS. 4 and 5) separates the leading portion 160 from the sheath inner surface 146. An additional isolating member is formed by a spacer 220. Whereas the planform of the scrim covers essentially the entire planform of the joint along the sheath channel 144, the exemplary spacer has more limited planform. In the exemplary embodiment, the spacer (shown in pre-installation planform in FIG. 6) has a spine or trunk 230 and a plurality of arms or branches 232, 234 extending from the spine. Inboard surface/face 236 and outboard surface/face 238 are shown. The spine is positioned between the leading edge 162 of leading portion 160 and the channel base 148. The exemplary arms 232 and 234 respectively extend downstream along the pressure side and suction side of the leading portion. End portions 240 of the arms (ultimately cut off) extend during manufacture along the pressure side and suction side of the main body downstream from the respective shoulders.

Figure 6:
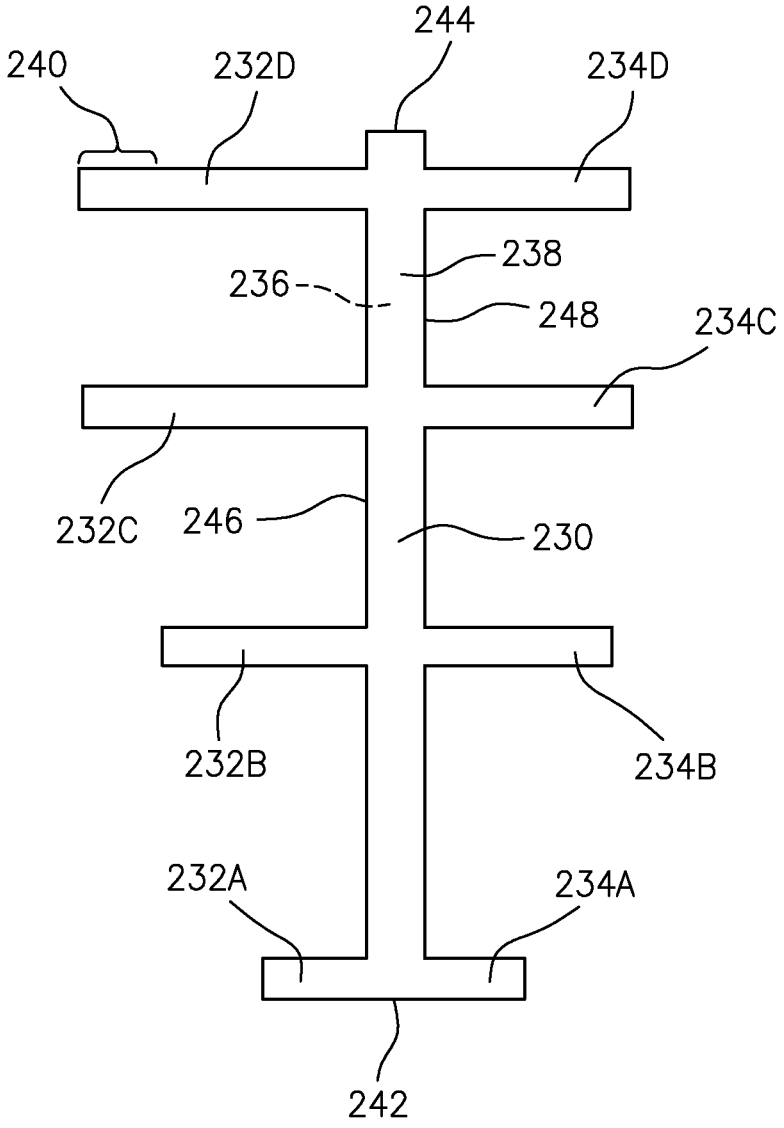
FIG. 6 is a plan view of a spacer before installation.

The spacer spine 230 (shown in pre-installation planform in FIG. 6) extends from an inboard end 242 to an outboard end 244 and has respective first and second edges 246 and 248 from which the arms extend. FIG. 6 subnumbers the arms 232 as 232A, 232B, 232C and 232D and the arms 234 as 234A, 234B, 234C and 234D from inboard to outboard. Although four arms per side are shown, there need not be the same arm count on each side and different numbers of arms may be used. Exemplary arm count is 2-10 per side, more narrowly 3-6. Exemplary spacer coverage is less than 50% of the planform of the joint. Although each illustrated arm is aligned with an arm on the opposite side and parallel thereto, other arrangements including offsetting the arms and angling them are possible.

The spacer improves galvanic isolation in two ways. First, the spine may directly act as a shield/barrier to penetration by burrs or other defects in the metal of either the sheath or main body. For this function, the spacer may be formed of a denser, less open material than the scrim (e.g., a tightly woven fabric versus an open mesh scrim having a greater fraction of open area). For example, the fabric of the spacer may have an open area fraction less than half the open area fraction of the mesh of the scrim, more narrowly less than 20% or even zero.

The spacer may be thicker than the scrim, for example, the thickness of the spacer fabric may be at least 150% of the thickness of the mesh, more particularly 150% to 1000% or 150% to 400%.

Second, the spacing function alone helps provide isolation (e.g., allowing for a relatively thick epoxy layer in the gaps between arms). Particularly where a dense material is used for the spacer, the skeletal structure offers ease of manufacture relative to a hypothetical variation having a dense spacer completely filling the joint planform (e.g., by reducing or eliminating any bunching, etc.).

Figure 4:
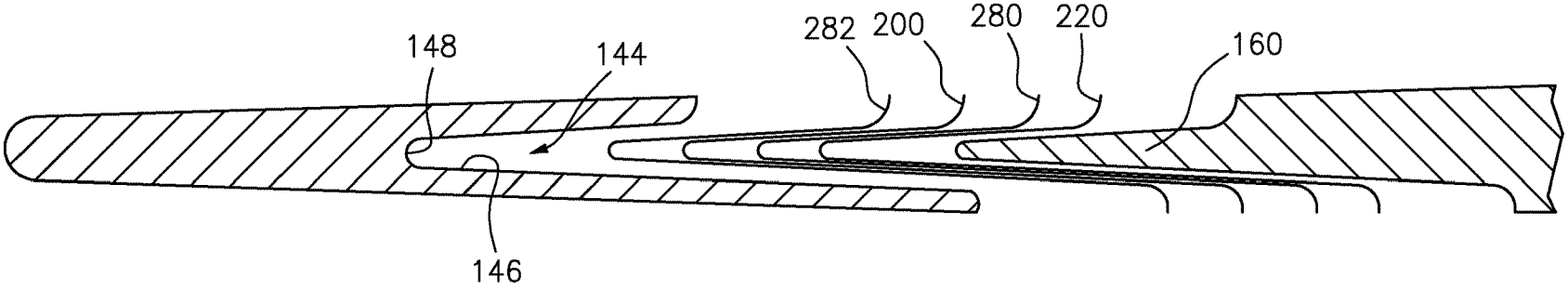
FIG. 4 is an exploded sectional view of the blade of FIG. 3 showing manufacturing features.
Figure 5:
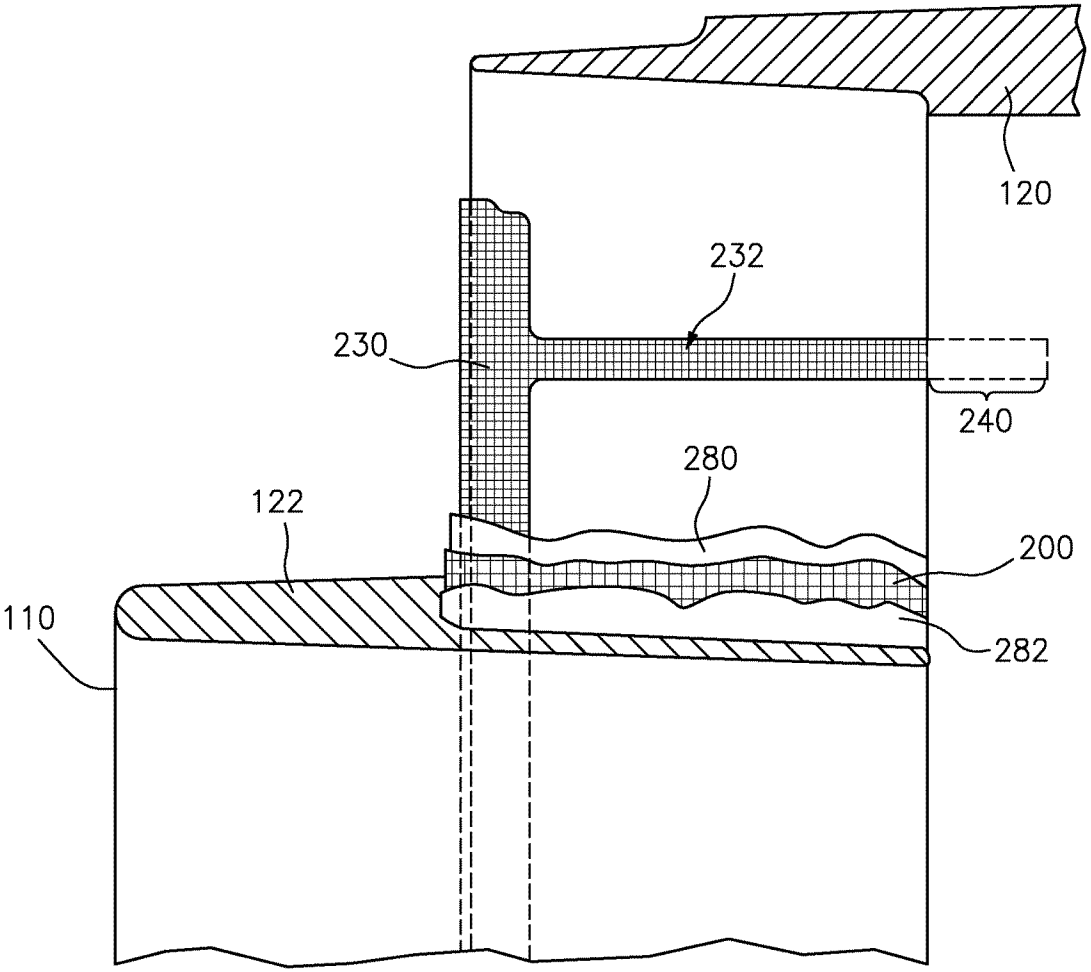
FIG. 5 is a cutaway view of the blade of FIG. 2.

FIG. 4 shows an exploded view reflecting a manufacturing process utilizing pre-formed adhesive films 280 and 282. Film 280 secures the scrim to the spacer and directly to the substrate in the gaps between spacer arms. Film 282 secures the sheath to the spacer. Upon curing, the adhesives (e.g., the epoxy of the prepreg. spacer and the films 280, 282) may integrate and lose any distinctions. Other adhesive application techniques are possible.

Exemplary spacer 220 material is a woven fiberglass fabric. Exemplary fabric is AMS 3824, style 7781 available from BGF Industries, Inc., Greensboro, N.C. The material may be preimpregnated with an epoxy resin to form a prepreg. Exemplary resin is CYCOM™ 306 of Cytec Industries Inc., Woodland Hills, N.J. The prepreg. may be cut to shape. Exemplary thickness of the spacer fabric prior to preimpregnation is 0.009 inch (0.23 mm). Exemplary thickness of the preimpregnated spacer is 0.013 inch (0.33 mm). A broader exemplary range of fabric thickness (approximating scrim thickness in the final composite) is 0.15 mm to 0.40 mm, more broadly 0.10 mm to 0.60 mm.

Exemplary scrim 200 material is a woven fiberglass mesh. An exemplary mesh is prefinished with a coupling agent finish. Exemplary mesh is style 1659 with a 550 finish of BGF Industries, Inc., Greensboro, N.C. Exemplary thickness of the scrim with finish is 0.004 inch (0.1 mm). A broader exemplary range of mesh thickness (approximating its thickness in the final composite) is 0.05 mm to 0.15 mm, more broadly 0.03 mm to 0.20 mm.

Exemplary adhesive film 280, 282 is an unsupported thermosetting, modified epoxy adhesive film such as 3M™ Scotch-Weld™ structural adhesive film AF 3109-2U of 3M, St. Paul, Minn. Exemplary initial film thickness is 0.005 inch (0.013 mm).

The first step is applying the precut spacer prepreg. 220 to the substrate. The end portions 240 (tabs) may be taped to the substrate. Then the film 280 is applied. Then scrim 200 is applied without epoxy. Then film 282 is applied. Then the sheath is applied.

The assembly is then shrink wrapped to compress. The wrapped assembly is then bagged and autoclaved to cure. After autoclaving the assembly is debagged/dewrapped and cleaned. Any flash may be removed and the protruding tabs 240 cut away.

Relative to a baseline scrim, the additional use of the spacer may improve galvanic isolation while not substantially adversely affecting sheath adhesion, precision of sheath mounting, rigidity of sheath mounting, and the like.

The use of "first", "second", and the like in the following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing baseline configuration, details of such baseline may influence details of particular implementations. Accordingly, other embodiments are within the scope of the following claims.

What is claimed is:

1. A airfoil member (100) comprising:
a substrate (120) along at least a portion of an airfoil (102) of the airfoil member;
a sheath (122) having a channel (144) receiving a portion (160) of the substrate;
a scrim (200) between the substrate and the sheath; and
a spacer (220) between the sheath and the substrate and having a plurality of spaced-apart portions (232, 234) with gaps between the spaced-apart portions,
wherein:
the spacer comprises glass fiber fabric;
the scrim comprises a mesh having an open area fraction; and
the spacer has an open area fraction less than half the open area fraction of the mesh of the scrim.

2. The airfoil member of claim 1 wherein:
the spacer (220) is between the scrim and the substrate.

3. The airfoil member of claim 1 wherein:
the substrate is a first metallic material; and
the sheath is a second metallic material different from the first metallic material.

4. The airfoil member of claim 3 wherein:
the first metallic material is an aluminum alloy; and
the second metallic material is a titanium alloy.

5. The airfoil member of claim 1 wherein:
the scrim mesh is a glass fiber mesh.

6. The airfoil member of claim 1 wherein:
the scrim has only a single mesh layer.

7. The airfoil member of claim 1 wherein the spacer comprises:
a spine (230) having a first edge and a second edge;
a plurality of first arms extending from the first edge; and
a plurality of second arms extending from the second edge.

8. The airfoil member of claim 7 wherein:
the spine is between a base of the channel and an edge of the received portion of the substrate;
the first arms extend downstream from the spine along a pressure side of the received portion; and
the second arms extend downstream from the spine along a suction side of the received portion.

9. The airfoil member of claim 1 wherein:
the spacer has a characteristic thickness of 0.15 mm to 0.40 mm; and
the scrim has a characteristic thickness of 0.05 mm to 0.15 mm.

10. The airfoil member of claim 1 being a fan blade.

11. The airfoil member of claim 1 wherein:
the sheath forms a leading edge (110) of the airfoil.

12. A method for manufacturing the airfoil member of claim 1, the method comprising:
applying the spacer to the substrate;
applying the scrim to the spacer and substrate; and
applying the sheath to the scrim.

13. The method of claim 12 wherein:
the spacer is applied as a prepreg.

14. The method of claim 13 wherein:
the prepreg. is an epoxy prepreg.

15. The method of claim 12 wherein:
the applying of the sheath leaves end portions (240) of the spaced-apart portions protruding along the substrate.

16. The method of claim 15 further comprising:
cutting off the end portions.

17. The method of claim 12 further comprising:
applying an adhesive (280) to secure the scrim to the substrate; and applying an adhesive (282) to secure the sheath to the scrim.

18. A turbine engine comprising the airfoil member of claim 1 as a fan blade.

19. The turbine engine of claim 18 wherein:

the sheath forms a leading edge (110) of the airfoil.

* * * * *